US005652001A

United States Patent [19]

Perry et al.

[11] Patent Number: 5,652,001

[45] Date of Patent: Jul. 29, 1997

[54] SPINNERETTE

[75] Inventors: Michael Robert Perry, Kenilworth; Alan Sellars, Goxhill; Patrick Arthur White, Sharnford, all of United Kingdom

[73] Assignee: Courtaulds Fibres Limited, London, United Kingdom

[21] Appl. No.: 66,779

[22] Filed: May 24, 1993

[51] Int. Cl.[6] ..... D01D 4/02; D01D 4/06

[52] U.S. Cl. ..... 425/382.2; 264/176.1; 425/464

[58] Field of Search ..... 425/72.2, 378.2, 425/382.2, 462, 463, 464; 264/176.1

[56] References Cited

U.S. PATENT DOCUMENTS

| | | | |
|---|---|---|---|
| 1,337,258 | 4/1920 | Ohlson | 425/464 |
| 1,366,166 | 1/1921 | Criggal | 425/464 |
| 2,385,856 | 10/1945 | Hayes | 425/464 |
| 2,408,713 | 10/1946 | Webb | 425/464 |
| 2,514,189 | 7/1950 | Spencer et al. | 425/72.2 |
| 2,553,692 | 5/1951 | Webb | 425/464 |
| 2,673,368 | 3/1954 | Denyes | 425/464 |
| 2,839,783 | 6/1958 | De Wolf | 425/464 |
| 2,985,911 | 5/1961 | Griset, Jr. | 425/464 |
| 3,210,451 | 10/1965 | Manning, Jr. et al. | 425/72.2 |
| 3,457,341 | 7/1969 | Duncan et al. | 425/72.2 |
| 3,857,665 | 12/1974 | Kennedy | 425/464 |
| 4,121,918 | 10/1978 | Shono et al. | 425/72.2 |
| 4,153,409 | 5/1979 | Capps et al. | 425/464 |
| 4,373,895 | 2/1983 | Yamamoto et al. | 425/462 |
| 4,416,698 | 11/1983 | McCorsley, III | 106/163.1 |
| 4,605,364 | 8/1986 | Roth et al. | 425/72.2 |
| 4,720,251 | 1/1988 | Mallay et al. | 425/464 |
| 5,112,550 | 5/1992 | Gotoh et al. | 425/464 |

FOREIGN PATENT DOCUMENTS

| | | | |
|---|---|---|---|
| 0430926A2 | 6/1991 | European Pat. Off. . | |
| 0494852A2 | 7/1992 | European Pat. Off. . | |
| 440886 | 6/1912 | France | 425/464 |
| 223740 | 6/1985 | Germany . | |
| 63-85103 | 4/1988 | Japan | 425/464 |
| 58010 | 8/1946 | Netherlands | 425/464 |
| 130702 | 12/1928 | Switzerland | 425/464 |
| 871875 | 7/1961 | United Kingdom . | |
| 963195 | 7/1964 | United Kingdom . | |
| 1054904 | 1/1967 | United Kingdom . | |
| 1124309 | 8/1968 | United Kingdom . | |
| 1602576 | 11/1981 | United Kingdom . | |

OTHER PUBLICATIONS

A10 Ullmann's Encyclopedia of Industrial Chemistry 550–55 (5th Ed. 1987).

Schwab, M., "Trends in Spinnerette Design as Seen by the Spinnerette Manufacturer," Fiber Producer 42, 44, 46, 48, 50 (Dec. 1978).

Langley, L., "Concepts of Spinnerette Design," Fiber Producer 14, 16–18, 74–75 (Apr. 1978).

"*Man–Made Fibers Science and Technology*", (New York 1967), vol. 1, Rosato Div., Polymer Engineering and Technology pp. 141–145.

Walczak, "*Formation of Synthetic Fibers*", 214–15 and 293–95 (New York 1977).

Serkov et al., "The Profile of Spinneret Holes," 6(1) Fibre Chemistry 65–68 (Jul. 1974).

Makhsudkhanov, Kh. U., et al., "Dependence of Acetate Fibre Spinning Process on the Form and Disposition of the Spinneret Holes," 13(4) Fibre Chemistry 241–243 (Mar. 1982).

(List continued on next page.)

*Primary Examiner*—Jay H. Woo
*Assistant Examiner*—Joseph Leyson
*Attorney, Agent, or Firm*—Fish & Richardson P.C.

[57] ABSTRACT

A spinnerette for the spinning of fibres has a rectangular frame with an upper flange for connection to a jet assembly and a lower planar apertured plate for the passage of spinning dope, the apertured plate being formed with its spinning holes and then electron beam welded into the bottom of the frame from the outside.

15 Claims, 4 Drawing Sheets

OTHER PUBLICATIONS

Pervadchuk, V.P., et al., "Pressure Distribution in a Channel of a Spinneret for Spinning Polymer Melts," 18(2) Fibre Chemistry 139–43 (Nov. 1986).

"Kasen Spinnerettes for Synthetic Fibres," brochure by Kasen Nozzle Mfg. Co. Ltd., Osaka, Japan.

"Spinnerettes", brochure by Nippon Nozzle Co. Ltd., 1–20.

"Ceccato Spinnerets," brochure by F.11i Ceccato, 1–11, Milan, Italy.

"Tanaka Spinneret," brochure by Tanaka Kikinzoku Kogyo K.K., 10–11.

"Spinnerettes," brochure by Courtaulds Engineering, Coventry, England.

English translation to European Patent Application No. 0,494,852 A2 published on Jul. 15, 1992.

English Abstract to European Patent Application No. 0,430, 926 A2 published on Jun. 5, 1991.

English Abstract to German Publication No. 277,289 published on Mar. 28, 1990.

Patent Abstracts of Japan, vol. 12, No. 316 26 Aug. 1988 JP A 63 085 103, 15 Apr. 1988.

SPINNERETTE

BACKGROUND OF THE INVENTION

1. Field of the Invention

This invention relates to spinnerettes and has particular reference to spinnerettes suitable for the spinning of cellulose filaments from a solution of cellulose in a solvent, particularly a tertiary amine N-oxide..

2. Description of the Related Art

McCorsley U.S. Pat. No. 4,416,698, the contents of which are incorporated herein by way of reference, describes a method of producing cellulose filaments by dissolving the cellulose in a suitable solvent such as a tertiary amine N-oxide.

One of the features of such a system is that the solution, commonly referred to as a dope, is both hot and, if it contains a significant quantity of cellulose, viscous, requiring the use of extrusion pressures in the range 15 bar to 200 bar. Such pressures are similar to those experienced in melt-spun polymer systems, such as polyester systems.

Having produced the solution of cellulose in the solvent the solution is extruded or spun through a suitable die assembly including an unspecified jet to produce filamentary material which is passed into water to regenerate the cellulose by leaching out the amine oxide solvent from the extruded filaments.

The production of artificially formed filaments of material by extruding or spinning a solution or liquid through a spinnerette to form the filaments is, of course, well known. Initially, relatively small numbers of individual filaments were prepared, which filaments were individually wound up for use as continuous filament material. This meant that the number of continuous filaments which needed to be produced was essentially dictated by the number of filaments which could be individually wound either before or after drying.

However, if fibre is produced as a tow or if fibre is produced as staple fibre then different criteria apply to the number of filaments which can be produced at any one time. A tow essentially comprises a bundle of essentially parallel filaments which are not handled individually. Staple fibre essentially comprises a mass of short strands of fibre. Staple fibre can be produced by the cutting of dry tow or it can be produced by forming a tow, cutting it whilst still wet, and drying the cut mass of staple fibre.

Because there is no need to handle individual filaments in the case of a tow product or a staple product, large number of strands or filaments can be produced simultaneously.

Thus in the case of spinnerettes for the production of tow or staple fibre, in comparison to spinnerettes used for the production of continuous filament material, it is economically essentially to use spinnerettes with a large number of spinning holes.

Initially, a spinnerette for the production of continuous filament might have had 20 to 100 holes, with productivity being increased by the use of higher spinning speeds. With spinnerettes used for the production of tow or staple the numbers of holes can grow into thousands or even tens of thousands. Productivity can thus be increased by the use of more holes as well as higher speeds. Initially such spinnerettes with large numbers of holes were produced in thick plates, as in polyester jets. However, it is expensive and time consuming to produce large numbers of holes in such thick plates. Thus attempts were made to use thinner plates by taking a dish of metal and forming the holes through the dish to produce a spinnerette in the form of a dished member with the holes arrayed in some suitable pattern in the lower portion of the dish. Such a dish member was then bolted into a jet for the production of the spun material.

Unfortunately, however, the production of jets is a very expensive and time consuming process. Each hole has to be pierced individually. Very often the holes are of a complex shape and are produced by a series of drilling, punching or machining operations, which have only recently been semi-automated.

With any production process there is a risk of defects and for a given percentage defect level, however low, the absolute number of defects per jet will increase as the number of holes in the jet increases. This can mean that there reaches a stage where it is not practical to increase the number of holes in a single jet face because of the chances that the final product will have too many defects to be useful without subsequent refurbishment.

One way round this problem is the adoption of the so-called cluster jet or thimble jet. In a cluster jet a large number of small thimbles are produced each with a relatively small number of holes—say 1 to 1500 holes. Such cluster jets have been widely used in the production of cellulose filaments by the viscose process. The cluster jets can be manufactured relatively cheaply and if a defect is found in one hole the particular thimble can be rejected without losing the work of producing many thousands of holes. The thimbles are then inserted into a holder in such a way that the pressure of the dope or spinning solution acting within the spinnerette tends to firmly force the spinnerettes into the cluster jet holder assembly.

Such jet assemblies of the single dished jet with a large number of holes or a cluster jet are widely used in the production of viscose cellulose. Viscose cellulose is produced by wet spinning. Examples of such jets are to be found in Ullman Encyclopaedia of Industrial Chemistry, 5th Edition, 1987, volume A10, page 554.

Ullman also refers to the use of rectangular spinnerettes in the spinning of polyolefin fibres.

The present invention is concerned with the production and structure of a spinnerette particularly suited for the production of cellulose fibres from a solution of cellulose in a solvent. Such jets are further particularly useful for the production of staple fibre of cellulose from a solution of cellulose in a solvent such as amine oxide.

The spinnerettes of the invention are particularly suitable for use in the jets for the production of cellulose for the manufacture of staple fibre as described in the co-pending application for our common assignee number 08/066,777 filed on May 24, 1993 reference "Jet Assembly", now U.S. Pat. No. 5,527,178.

SUMMARY OF THE INVENTION

By the present invention there is provided a spinnerette for the spinning of a plurality of cellulose filaments from a solution of cellulose in a tertiary amine oxide, the spinnerette:

(i) being of generally top-hat shape in cross-section and comprising, (ii) a generally rectangular stainless steel frame having in plan view a major axis and a minor axis, (iii) an outwardly extending flange around one end of the said frame, (iv) integral internal braces extending within the generally rectangular frame along both the major axis and the minor axis so as to divide the frame into a plurality of apertures, (v) rebates of a given depth around the inwardly directed edges of each of the apertures remote from the flange, (vi) a plurality of aperture plates each of a thickness in the range 0.5 to 3.0 mm and corresponding substantially to the given depth of the rebates, the aperture plates fitting into the apertures so that the periphery of each aperture plate is located within the rebate of the aperture, (vii) each aperture plate being electron beam welded around its entire periphery into its rebate, the weld being on the exterior of the spinnerette, (viii) each aperture plate having a plurality of holes for the spinning of a plurality of filaments, (ix) the holes being tapered so as to have a larger internal diameter on the interior of the spinnerette than on the exterior of the spinnerette, (x) the upper edges of the said integral internal braces lying in substantially the same plane as the upper face of the flange, (xi) the upper edges of the said integral internal braces being tapered so as to narrow towards the plane of the upper face of the flange, (xii) the holes formed in the aperture plates having centres no more than 2 mm apart where said holes are surrounded by adjacent holes, (xiii) the holes having a diameter in the range 25 μm to 200 μm in their smallest diameter, (xiv) the holes in at least one edge portion of an aperture plate having a larger smallest diameter than the holes in the central portion of that plate.

(xv) said holes being formed in said apertures plates prior to said aperture plates being welded into said frame, and (xvi) each of said aperture plates having between 500 and 10,000 holes.

The present invention further provides a method of manufacturing a spinnerette for the production of a plurality of cellulose filaments from a solution of cellulose in a tertiary amine oxide, which comprises:

(i) providing a stainless steel framework including an outer wall of a generally rectangular shape in plan view, said outer wall defining a space of a depth between the two edges of the wall equal to the depth of the spinnerette, said rectangular framework having a length and a width, wherein said length is greater than said width so as to define a major axis and a minor axis, (ii) at one peripheral edge of the wall providing an outwardly extending flange around said periphery of said wall integral with said wall, (iii) providing within said outer wall at least one major axis internal bracing wall and at least one minor internal axis bracing wall transverse to said major axis bracing wall defining a plurality of apertures through the framework, (iv) forming rebates in the portions of said outer wall and the portions of said braces at the outer edge thereof around the periphery of each aperture to accommodate in each aperture an aperture plate, (v) forming each of the braces with a tapered upper edge remote from the rebated edge.

(vi) forming a plurality of aperture plates from stainless steel dimensioned to fit into the rebates around the apertures, (vii) forming a plurality of spinning holes in each of said aperture plates through which said cellulose solution can pass to form said filaments, (a) said holes being tapered so as to be larger in diameter on one side of said aperture plate than on the other side, (b) the smallest diameter of said holes being in the range 25 μm to 200 μm in diameter, (c) said holes being spaced from one another by a centre to centre distance in the range 0.5 mm to 3 mm.

(viii) subsequent to the formation of the spinning holes in each of said aperture plates locating the said aperture plates in the said rebates in the apertures with the side of the aperture plate having said larger diameter portion of said holes towards the bottom of the rebate, and (ix) electron beam welding said aperture plates to the framework and braces around the entire periphery of each aperture plate.

The present invention yet further provides a spinnerette in the form of a rectangular metal framework and an aperture plate, the aperture plate being welded into the framework so as to have the periphery of an inner side of the aperture plate abutting the framework, the framework having a rebate to accommodate the aperture plate, the aperture plate having a plurality of spinning holes, the holes being tapered in internal diameter, and being larger on the inner side of the aperture plate.

The present invention yet further provides a spinnerette comprising a metal aperture plate, said plate having a plurality of holes for the spinning of a fibre from a spinning solution, said aperture plate being welded around its periphery to a metal frame member. The frame member may have, at its end opposed to said aperture plate, an outwardly extending integral flange. The aperture plate may be electron beam welded to the frame member.

The frame member may have a rebate into which the aperture member is located and welded. The aperture plate may be stainless steel, the frame member may be stainless steel. The aperture plate may be rectangular.

There may be at least one internal brace in the interior of the metal frame to provide at least two apertures there through and in which the apertures are preferably rectangular. There may be at least two internal braces at right angles one to the other to form at least four apertures.

The holes in the aperture plate may have a plurality of diameters, with the smallest diameter portions of the holes on the side of the aperture plate away from the frame. The holes may extend closely to the edges of the aperture plates. The diameter of the holes in the central region in the aperture plate may be smaller than the diameter of the holes adjacent at least one of the edges of the plate. The braces may be tapered at their upper edges. The tapers may be so formed that the area of each aperture at the entrance as defined by the tapered edges is equal. The aperture plate may be formed of AISI 430 stainless steel, and the frame member may be formed of AISI 304 stainless steel.

Preferably the spinnerette is such that the frame member has a face away from the aperture plate, and the free edges of the internal braces lie in the same plane as the face of the frame member. The present invention further provides a spinnerette for the spinning of a plurality of cellulose filaments from a solution of cellulose in a solvent, the spinnerette having a portion through which the solution is passed to form the filaments, characterised in that the holes on one edge of the spinnerette are larger in diameter at their smallest diameter portion than the holes in the central region of the spinnerette.

The present invention further provides a method of manufacturing a spinnerette for the production of a plurality of cellulose filaments from a solution of cellulose in a solvent for the cellulose, which comprises:

(i) providing a metal framework including an outer wall of a generally rectangular shape in plan view, said outer wall defining a space of depth between the two edges of the wall equal to the depth of the spinnerette, said rectangular framework having a length and a width, wherein said length is greater than said width so as to define a major axis and a minor axis, (ii) at one peripheral edge of the wall providing an outwardly extending flange around said periphery of said wall integral with said wall, (iii) providing within said outer wall at least one major axis internal bracing wall and at least one minor axis bracing wall transverse to said major axis bracing wall defining a plurality of apertures through the framework, (iv) forming rebates in the portions of said outer wall and the portions of said braces at the outer edge thereof around the periphery of each aperture to accommodate in each aperture an aperture plate, (v) forming a plurality of metal aperture plates dimensioned to fit into the rebates around the apertures, (vi) forming a plurality of spinning holes in each of said aperture plates through which said cellulose solution can pass to form said filaments.

(vii) subsequent to the formation of the spinning holes in each of said aperture plates locating the aperture plates in the rebates in the apertures.

(ix) welding said aperture plates to the framework and braces around the entire periphery of each aperture plate.

The present invention yet further provides a spinnerette for the spinning of a plurality of cellulose filaments from a solution of cellulose in a solvent for the cellulose, the spinnerette:

(i) being of generally top-hat shape and comprising, (ii) a generally rectangular stainless steel frame having in plan view a major axis and a minor axis, (iii) an outwardly extending flange around one end of the said frame, (iv) integral internal braces extending within the generally rectangular frame along both the major axis and the minor axis so as to divide the frame into a plurality of apertures, (v) rebates of a given depth around the inwardly directed edges of each of the apertures remote from the flange, (vi) a plurality of aperture plates each of a given thickness corresponding substantially to the given depth of the rebates, the aperture plates fitting into the apertures so that the periphery of each aperture plate is located within the rebate of the aperture, (vii) each aperture plate being welded around its entire periphery into its rebate, the weld being on the exterior of the spinnerette, (viii) each aperture plate having a plurality of holes for the spinning of a plurality of filaments, and (ix) said holes being formed in said apertures plates prior to said aperture plates being welded into said frame.

DESCRIPTION OF THE PREFERRED EMBODIMENT

Figure 1A:
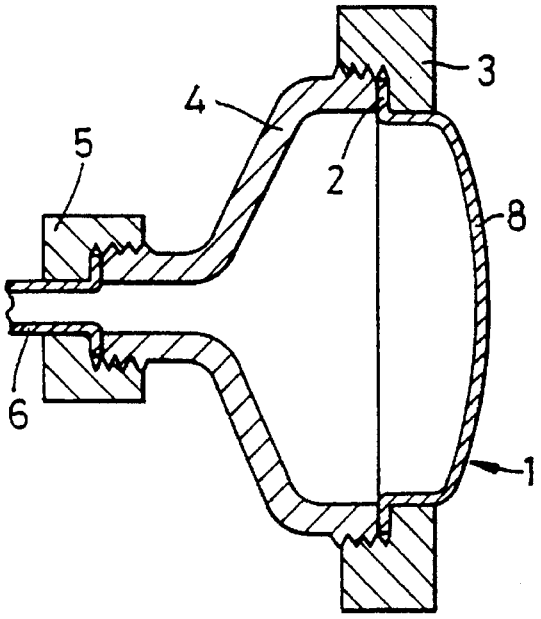
FIGS. 1*a*, 1*b* and 2*a*, 2*b* of the drawings of the present application illustrate prior art spinnerette designs of the simple dish type and of the cluster jet type.
Figure 1B:
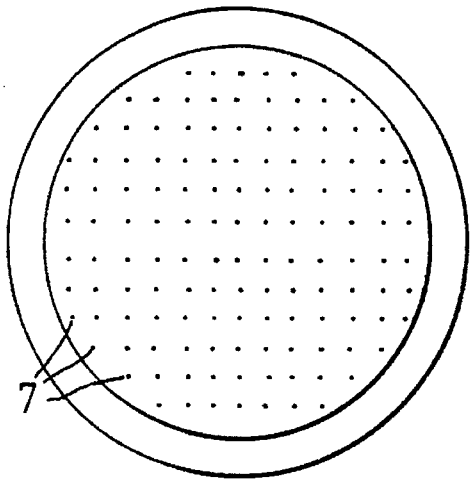

Referring to FIGS. 1*a* and 1*b* these show a prior art spinnerette (seen in sectional view in FIG. 1*a*) in the form of a dished plate 1 (seen in end-on view in FIG. 1*b*) having an integral flange portion 2. The flange 2 is trapped between a large nut 3 screwed onto the back of a jet head 4. In turn the jet head is connected via any suitable coupling member 5 to a pipe 6 for the supply of spinning solution, commonly referred to as a dope. Such a prior art device essentially has a plurality of holes 7 formed in the base 8 of the dish to produce from the dope the filaments which form the fibre. In the case of such a spinnerette used in the production of viscose rayon, the spinnerette would be immersed in a spin bath to regenerate cellulose fibres from the dope as it passes into the spin bath. For the production of continuous filament viscose, the number of holes 7 would be in the range of about 10 to 100.

For the production of tow (a plurality of essentially parallel filaments used as such) or staple fibre (small lengths of individual fibres produced by cutting up a tow) the number of holes 7 can be increased to a very high level indeed. The prior art devices of this type may typically be formed as large as 10 cm in diameter and may have as many as 50,000 holes. The holes may be arrayed in patterns, such as segments, as is, for example, illustrated in Ullman 5th Edition 1987, volume A10, page 554.

Figure 2A:
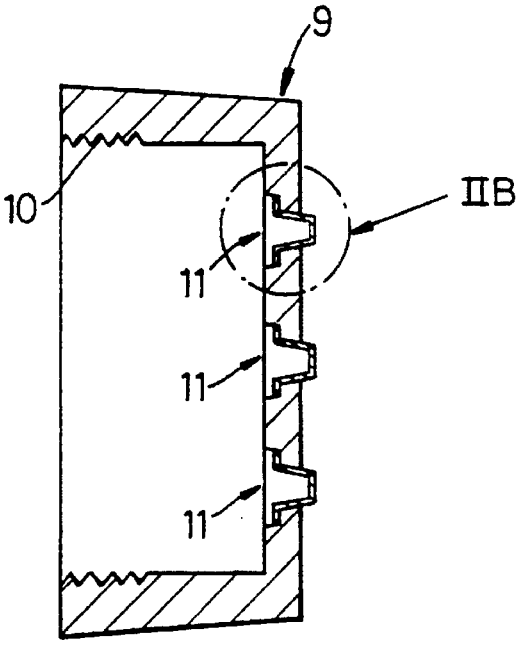
Figure 2B:
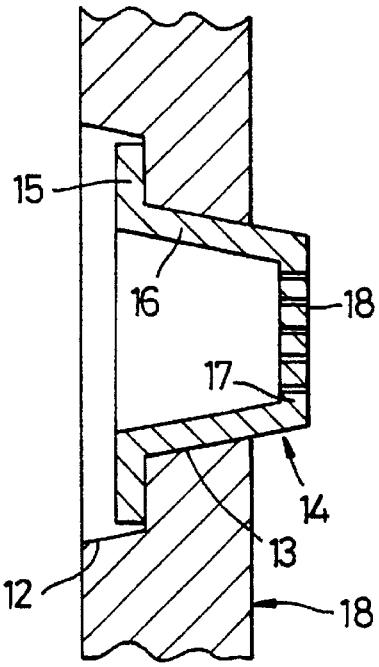

For the reasons outlined above, increasing the number of holes in the spinnerette can cause practical manufacturing problems which are associated with the virtual impossibility of reducing the statistical defect rate to zero. One answer to this problem is the use of a cluster jet of the type illustrated in FIGS. 2*a*, 2*b*. The portion of the cluster jet illustrated in FIG. 2 effectively replaces the dished plate 1 and nut 3 and is screwed by an internal thread onto the backing member 4 illustrated in FIG. 1A. In the embodiment illustrated in FIG. 2A and 2B the cluster jet comprises a substantial metal dished member 9 having the internal thread 10 referred to above and being formed with a series of stepped bores 11. These bores have a larger diameter 12 on the inside and a smaller diameter 13 on the outside. Located within the stepped bores 11 are a series of thimbles such as thimble 14 which in turn has an integral flange 15 an annular wall 16 and a base 17. The spinning holes 18 are formed in the base 17. In such prior art devices the thimbles are inserted from the inside of the substantial holder so that the action of the pressure of the dope on the thimbles is to force the dope into strong contact with the thimbles 12 so as to urge the thimbles into contact with the tapered portion 13 of the holes. The purpose of inserting the thimbles from the inside is to enhance sealing of the thimbles in the holes by having the pressurised dope act in a direction to enhance sealing. If required, each thimble may be screwed into the hole or maybe retained in the hole by providing in the portion 12 of the hole a female thread and threading a tubular male member (not shown) into the threaded bore portion 12 of the hole 11. The thimbles 14 may project beyond the face 18 of the member 9. This can clearly be seen in the Ullman Encyclopaedia article referred to above page 554, volume A10, 1987.

Figure 3:
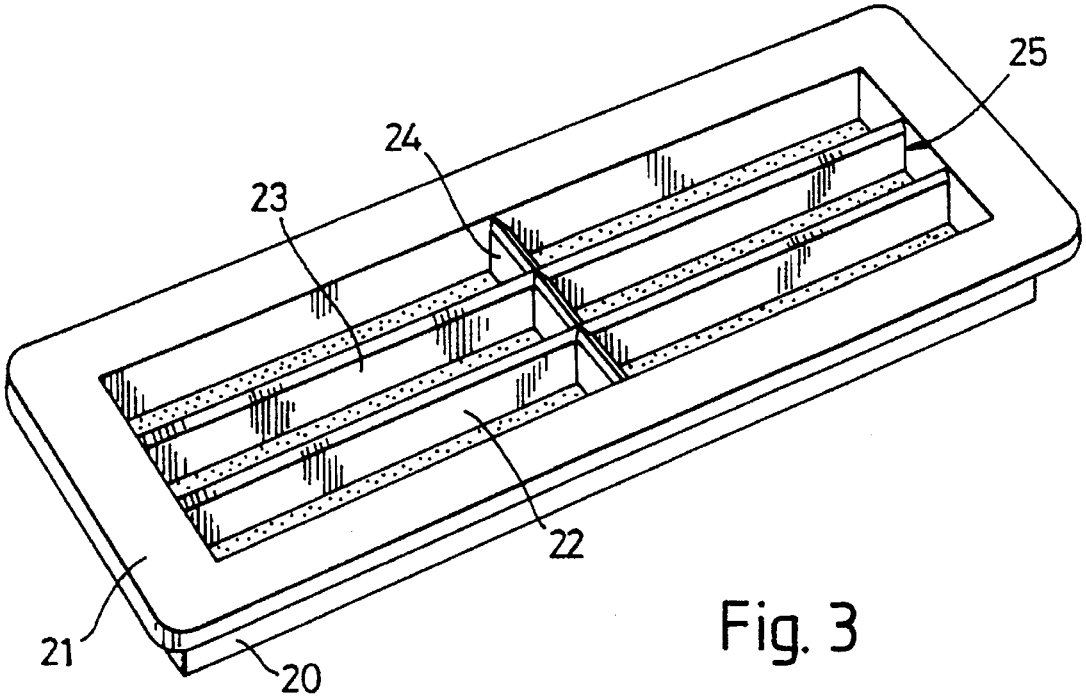
FIG. 3 is a perspective view of the spinnerette of the invention.
Figure 4:
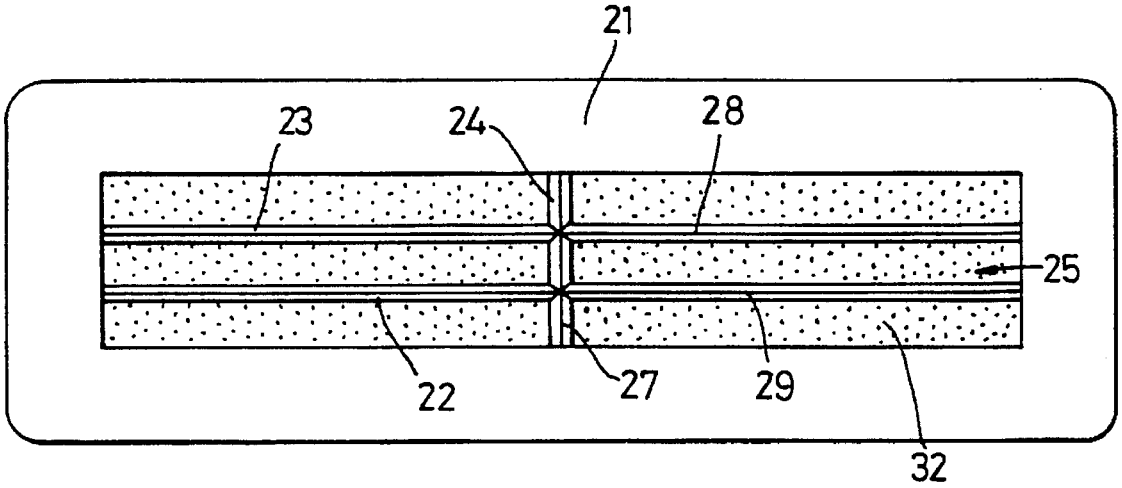
FIG. 4 is a plan view of FIG. 3.
Figure 5:
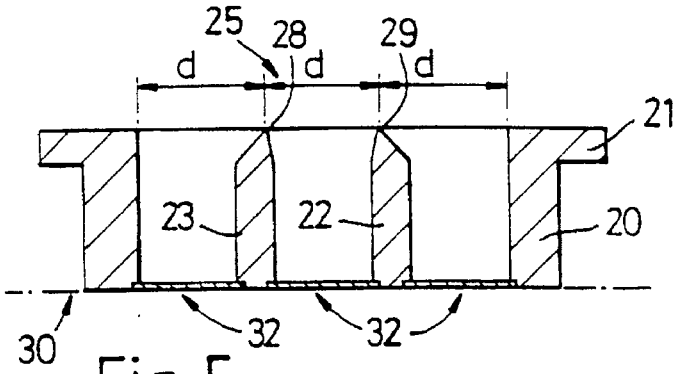
FIG. 5 is a sectional view of FIG. 3.
Figure 6:
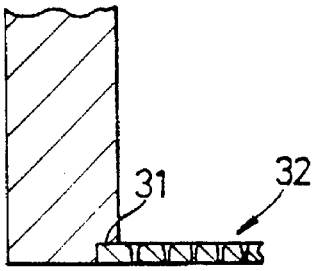
FIG. 6 is an enlarged view of a corner of FIG. 5.

Referring to FIGS. 3 to 8 these show a spinnerette in accordance with the present invention. The spinnerette is essentially of rectangular shape as shown in FIG. 3. The spinnerette is of generally top hat shape having a rectangular outer wall 20 with an integral upper flange member 21. The flange member may be provided with holes. Located within the wall 20 and integral with or welded thereto are a series of bracing walls 22, 23, 24. The braced structure may in the case of an integral unit be machined from a single plate or thin slab. The bracing walls 22 and 23 are formed along the major axis of the spinnerette and the bracing wall 24 lies transverse to the major axis along a minor axis of the spinnerette. The bracing walls form, together with the outer wall 20, a series of apertures or windows such as aperture 25. The material from which the outer wall and braces of the spinnerette is formed is preferably stainless steel and is further preferably stainless steel in accordance with AISI code 304. The upper walls of the braces 22, 23 and 24 are tapered to form substantially knife edge lines such as lines 27, 28, 29. The knife edge 27 of the brace 24 is centrally located on the brace, but the knife edges 28, 29 of the braces 22 and 23 are located to one side of the brace members, so that the distances d are all equal, and hence, as the apertures are all the same length, the areas of the apertures are all the same. This means that, in use, substantially equal amounts of dope are passed into each aperture. The use of tapered braces reduces the pressure drop of the dope across the jet compared to flat topped braces.

Figure 7:
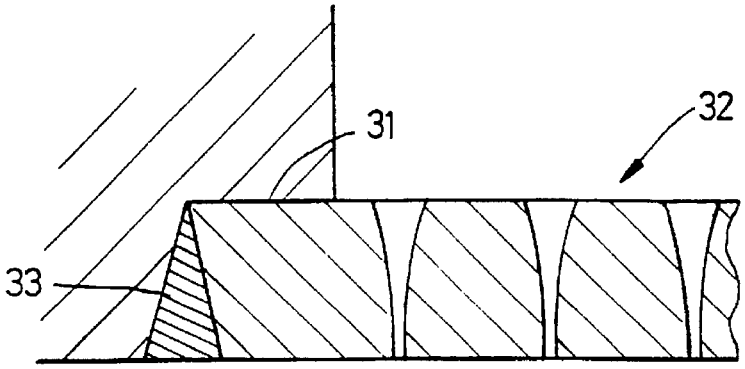
FIG. 7 is a further enlarged view of FIG. 6.
Figure 8:
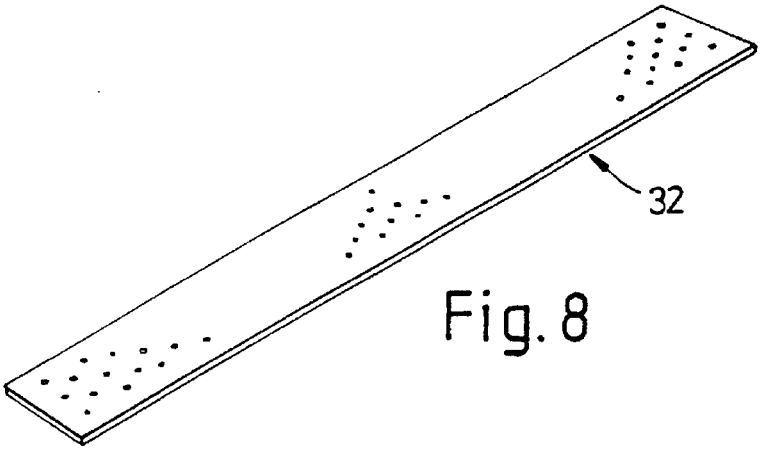
FIG. 8 is a perspective view of an aperture plate.

At their lower ends, the peripheral outer wall 20 and the bracing walls 22, 23, 24 define the lower edges of the apertures. The bottom of each of the bracing walls lies in the same plane 30 as the base of the outer wall 20. Around each aperture the walls are rebated such as at 31 to accept an aperture plate 32. The aperture plate 32 is also formed of stainless steel, in this case AISI code 430 stainless steel. Formed in the aperture plate 32 are a series of spinnerette holes produced by conventional processing techniques such as those described in "Fiber Producer" December 1978 pages 42 to 50 by Schwab of Enka, or in "Fiber Producer" April 1978 pages 14 to 18 and 74 to 75 by Langley of Spinning Services and Systems, the contents of both articles being incorporated herein by way of reference. The spinnerette holes are preferably tapered in form as shown in FIG. 7 so as to have a larger internal diameter on the inside of the jet and a narrower diameter on the outside of the jet. The plates, having been produced, are then located in the rebate 31 in the framework and braces of the spinnerette, and are electron beam welded around the periphery as at 33 to seal the plates within the apertures.

By selecting the plates 32 to be the same thickness as the depth of the rebate 31, and by the use of electron beam welding the underside of the spinnerette has a smooth face and effectively lies in the single plane 30.

Such spinnerettes are particularly suited for use in the jet assembly described in co-pending application Ser. No. 08/066,777, filed May 24, 1993, now U.S. Pat. No. 5,527,178 having the same assignee as this application.

Because the aperture plates can be punched prior to assembly into the jet, and because they are substantially rectangular in form and flat they are easily handled and punched. There is no need to punch holes into a dished flanged member as was necessary with prior art designs. This means that the holes can be punched right across the plate very close to the edge. This in turn means that the spinning holes can come very close to the outer walls of the plate and very close to the bracing walls. The use of electron beam welding minimises distortion of the assembly. By using the two particular grades of stainless steel referred to above, the softer grade used for the aperture plates can be punched to produce the shaped spinning holes whilst still being capable of being welded to the material of the frame. Electron beam welding is preferred as being a method of obtaining a high integrity joint without distorting the plates more than is necessary. Alternative methods of welding could include laser welding or plasma arc welding.

It can be seen, therefore, that the spinnerette has a smooth underside and may readily be manufactured from small components in terms of aperture plates whilst providing a large area for the production of large numbers of individual fibre strands.

The metal plates 32 preferably have a thickness in the range 0.5 to 3 mm. The use of the welded construction enables the plates to withstand the high internal pressures to which they are subjected in use. This means that the plates can be as thin as 0.5 mm whilst still enabling high pressure dope to be used in the production process. Alternatively, thicker plates may be provided such as plates as 0.75 mm or 1 mm or 1.25 mm or 1.5 mm or 2 mm or 2.5 mm or 3 mm. The plates may be of almost any length along the major axis, as the plates are supported by being welded on either side on the minor axis. Typically the width of the plate may be about 50 mm but it may be 10, 15, 20, 25, 30, 35 or 45 mm wide. The plates may be up to 500 mm long or even longer and typically can be 100, 150, 200, 250, 300, 350 or 400 mm long, the length to width ratio can be in the range 1:1 to 50:1.

Figure 9A:
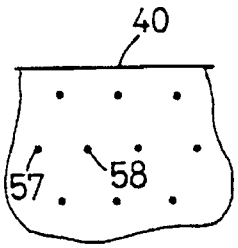
FIGS. 9A to 9G are plan views of portions of aperture plates.
Figure 9B:
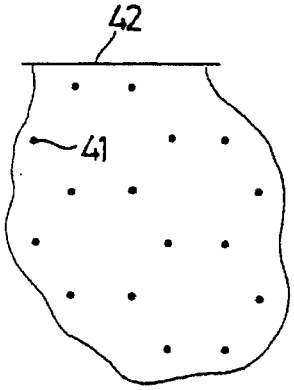
Figure 9C:
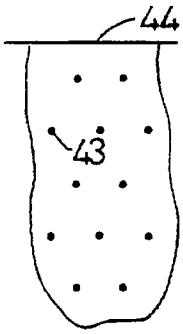
Figure 9D:
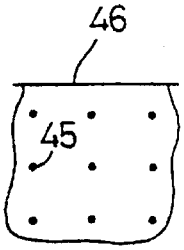

The use of AISI 430 stainless steel plate for the aperture plate 32 enables the holes to be punched readily through the plate. The holes are arrayed in a regular array on the plate. FIGS. 9A to 90 show preferred forms of regular array. In FIG. 9A the holes are located at the corners of equilateral triangles with the bases and apexes of the triangles located parallel one of the edges 40 of the aperture plate. In FIG. 9B the holes 41 are located at the corners of hexagons again with the hexagons having one edge parallel to an edge 42 of the aperture plate. In FIG. 9C the holes 43 are located at the corners of isosceles triangles with the base of the isosceles triangles being of less distance than the equilateral edges the bases may alternatively be longer than the edges. The bases are arranged parallel with an edge 44 of the aperture plate. In FIG. 9D the holes 45 are located at the corners of squares with an edge of the square parallel to an edge 46 of the aperture plate.

Figure 9E:
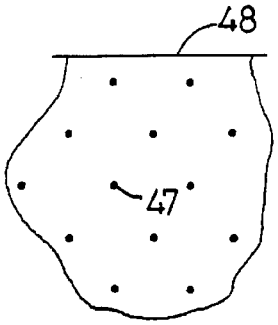

In FIG. 9E the holes 47 are located at the corners of diamonds with a diagonal of the diamond parallel to an edge 48 of the aperture plate.

Figure 9F:
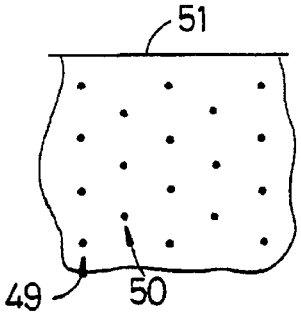
Figure 9G:
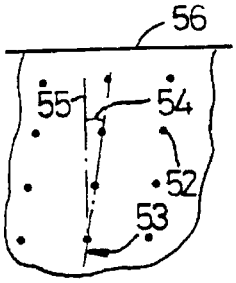

In FIG. 9F the holes are arrayed in two alternating rows 49, 50 with the rows being at right angles to the edge 51 of the aperture plate. It is not necessary for the rows to lie at a perpendicular to the aperture plate, for example in FIG. 9G the holes 52 are arrayed in lines such as line 53 which is at an angle 54 to a perpendicular 55 to an edge 56 of the aperture plate.

Typically there may be 2775 holes per aperture plate with a centre to centre packing distance for the holes being in the range 0.7 mm to 1.5 mm, typically 1.2 mm. Thus in the case of the holes illustrated in FIG. 9A each hole 57 would be at 1.2 mm from its nearest neighbour hole 58. Obviously, in the case of holes arrayed in different packing arrangements, the intercentre distance will differ from one hole to the other.

Figure 10:
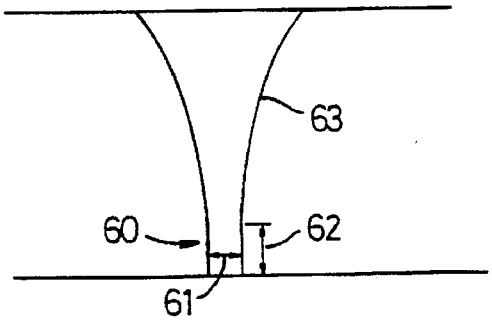
FIG. 10 is a sectional view of a hole.

A cross section of a typical hole is shown in FIG. 10. The hole is substantially trumpet shaped having a substantially parallel section 60 which has an internal diameter 61 and a length 62. Above the parallel portion 60 there is a tapered conical portion 63. The length 62 of the narrow portion 60 is approximately equal to the diameter 61 of the narrow portion 60. The length of the hole is effectively, the length of the capillary or substantially parallel portion 60. The tapered portion 63 is effectively a means of delivering dope into the portion 60 of the hole. The portion 60 may have a diameter of 25 microns or 35 microns or 40 microns or 50 microns or 60 microns or 70 microns or 80 microns or 90 microns or 100 microns or 110 microns or 120 microns or 150 microns, depending on the eventual decitex of the fibre which is to be manufactured using the spinnerette. The length 62 may be equal to the diameter 61 or may be in the range 0.1 to 10 or 0.5 to 2 times the diameter 61.

The holes in the spinnerette can be made by any conventional manner, usually by drilling, punching and broaching. Typical manufacturing processes are described in the articles by Schwab and Langley in "Fiber Producer" referred to above.

In the spinnerette of the invention, it is not essential that all of the holes have the same diameter in their capillary portion 60.

Figure 11:
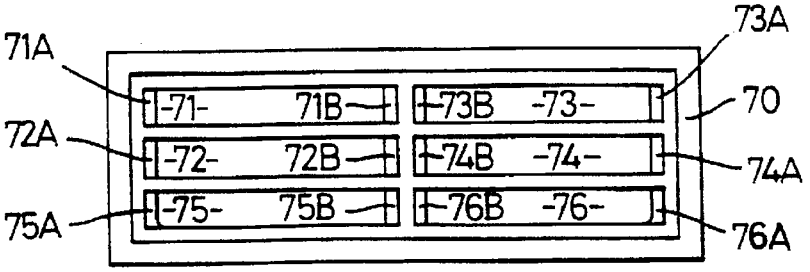
FIG. 11 is a plan view of a spinnerette.

Referring to FIG. 11 this shows a plan view of a spinnerette having an outer flange 70 and containing six aperture plates 71 to 76. The aperture plates are welded into a framework in the manner illustrated in FIGS. 3 to 8. On either opposite side of the aperture plates 71 to 74 in the regions 71A, 71B to 74A, 74B the capillary portion of the holes is about 10 per cent larger in diameter than the capillary portion in the remaining parts of the plates 71 to 74. Similarly the capillary portions of the holes in the regions 75A, 75B and 76A, 76B are approximately 10 per cent larger in diameter than the holes in the remaining portions of the plates 75 and 76.

Rather than having the tapered portion 63 as a smooth taper, it may be easier to form the taper in a series of conical regions merging into the parallel portion 60.

The welded structure spinnerette of the invention has a number of very significant advantages over the prior art structures.

The welded structure permits the use of thin aperture plates whilst still enabling a large area to be provided within which the aperture holes can be made. The thin jet plates can be welded into a framework so as to withstand the distortion effects which arise with the use of high pressure dope. This advantage is of particular significance when using the jets with high viscosity dope. The use of high viscosity dopes inevitably means that if high throughputs are required high pressures such as up to 200 bar must be used to force the dope through the aperture holes.

The welded structure also minimises dead areas within the spinnerette where the spinning solution can stagnate. These otherwise can give rise to non-uniform spinning, particularly in the case of spinning a hot dope into a cool region. The welded structure can readily be manufactured with a smooth underface.

A yet further advantage is that it enables rectangular designs readily to be produced. Because the plates can be preproduced prior to welding into the framework, the plates can have holes close to their edges. The plates can all be the same size, which means that the aperture plates can be manufactured on a repetition basis and if one plate contains defective holes than only a single plate needs to be rejected. Compared, therefore, to a large single plate jet the product of the invention is much more easy to manufacture and much less susceptible to distortion under pressure. If pressed single jet plates are used of the type illustrated in FIG. 1A it is very difficult to produce such a jet with holes close to the edges because of the difficulty of working inside a dished member. If only a single plate is used, it needs to be thick to avoid collapse which means that it is difficult to form holes through the plate and, therefore, it is not possible to pack the holes closely together.

The use of AISI 430, containing 16–18% by weight chromium and low levels of nickel (less than 0.5%) manganese (less than 0.5% by weight ) and molybdeum (less than 0.5% by weight) as well as low levels of carbon (less than 0.12% by weight) means that the plates may be punched and welded whilst still able to resist the conditions of use.

What is claimed is:

1. A spinnerette for the spinning of a plurality of cellulose filaments from a solution of cellulose in a tertiary amine oxide comprising:

(a) a generally rectangular stainless steel frame having a generally top-hat vertical cross-section, an upper end and a lower end, and, in plan view, a major axis and a minor axis, (b) an outwardly extending flange having an upper face and a lower face around the upper end of said frame, (c) internal braces integral with said frame extending within the generally rectangular frame along both the major axis and the minor axis so as to divide the frame into a plurality of apertures, (d) the upper edges of said integral internal braces lying in substantially the same plane as the upper face of the flange, (e) said integral internal braces being tapered so as to narrow towards the upper face of the flange, (f) rebates around the inwardly directed edges of each of the apertures at the lower end of the frame, (g) a plurality of aperture plates having upper and lower faces, a thickness in the range of 0.5 to 3.0 mm and corresponding substantially to the depth of the rebates, the aperture plates fitting into the apertures so that the periphery of each aperture plate is located within the rebate of the aperture, (h) an electron-beam weld around the periphery of each aperture plate securing said plate in the rebate, the weld being on the exterior of the spinnerette, (i) each aperture plate having a plurality of preformed holes for the spinning of a plurality of filaments, (j) the holes being tapered and having a largest diameter on the upper surface of the plate and a smallest diameter on the lower face of the plate, (k) the holes formed in the aperture plates having centres no more than 2 mm apart where said holes are surrounded by adjacent holes, (l) the smallest diameter of the holes being from about 25 μm to about 200 μm, (m) the holes in two opposite edge portions of one of said aperture plates having a smallest diameter which is larger than the smallest diameter of the holes in the central portion of that plate and is larger than the smallest diameter of the holes at the other edge portions of the plate, (n) each of said aperture plates having between 500 and 10,000 holes.

2. A spinnerette for spinning cellulose filaments from a solution of cellulose in amine oxide comprising a rectangular metal frame member having a first end and a second end opposite to said first end, said frame member having a rectangular mounting surface at said first end and rebates at said second end, at least one aperture plate seated in said rebates so as to have an inner side of the aperture plate abutting the frame member, said aperture plate having a plurality of tapered spinning holes, the diameter of said holes being largest toward the first end of said frame member and smallest at said second end of said frame member, the holes at two opposite edge regions of said aperture plate having a smallest diameter which is larger than the smallest diameter of the holes along other edge regions of said aperture plate and is larger than the smallest diameter of the holes in the central region of the plate, and welds retaining said plate in said rebates.

3. A spinnerette according to claim 2, comprising at least two of said aperture plates, each of said plates having a peripheral edge and being made of metal and in which said ends of said frame member are joined by a wall, and further comprising at least one internal brace integral with said wall, said wall and said at least one internal brace defining at least two apertures for mounting one of said aperture plates in each said aperture, at least one of said aperture plates being welded at its peripheral edge to said frame member at the second of said ends of the frame member within a respective one of said apertures to define an internal face of said frame member and an external face of the frame member, each of said aperture plates being welded at its peripheral edge to at least one of said braces.

4. A spinnerette as claimed in claim 3 in which said frame member has at its first end opposed to said aperture plate an outwardly extending integral flange.

5. A spinnerette as claimed in claim 3 in which said aperture plate is electron beam welded to said frame member.

6. A spinnerette as claimed in claim 3 in which said aperture plates are stainless steel.

7. A spinnerette as claimed in claim 3 in which said frame member is stainless steel.

8. A spinnerette as claimed in claim 3 in which there are at least two of said internal braces at right angles one to the other to form at least four apertures in said frame member.

9. A spinnerette as claimed in claim 8 in which the braces at their edges nearest to the first end of said metal frame member are tapered to narrow in the direction of said first end, the extremities of said tapered edges defining entrances to said apertures.

10. A spinnerette as claimed in claim 9 in which the tapered edges are so formed that the area of each aperture at the entrance as defined by the tapered edges is equal.

11. A spinnerette as claimed in claim 3 in which the aperture plates are formed of AISI 430 stainless steel.

12. A spinnerette as claimed in claim 11 in which the frame member is formed of AISI 304 stainless steel.

13. A spinnerette as claimed in claim 8 in which the first end of said metal frame member and said braces at their edges nearest to the first end of said metal frame member lie in the same plane.

14. A spinnerette for use in the spinning of a plurality of cellulose filaments from a hot viscous solution of cellulose in a solvent, the hot viscous solution being extruded under pressure through the spinnerette, the spinnerette having a first surface and a second surface and an edge and a central region and a plurality of holes extending between said surfaces through which the hot viscous solution is forced to form the filaments, wherein each of said holes has been formed to taper from a largest diameter at said first surface to a smallest diameter at said second surface, the holes along two opposite portions only of the edge of the spinnerette being larger holes having a smallest diameter which is larger than the smallest diameter of the holes in the central region of the spinnerette and is larger than the smallest diameter of the holes along the other portions of the edge of the spinnerette.

15. The spinnerette according to claim 14, wherein said spinnerette is rectangular and said larger holes are positioned along two opposite portions of the edge only of the rectangle.

* * * * *

UNITED STATES PATENT AND TRADEMARK OFFICE

CERTIFICATE OF CORRECTION

PATENT NO. : 5,652,001

DATED : July 29,1997

INVENTOR(S) : Perry et al.

It is certified that error appears in the above-identified patent and that said Letters Patent is hereby corrected as shown below:

On the title page, Item [73],
Change Assignee from "Courtaulds Fibres Limited" to --Courtaulds Fibres (Holdings) Limited--.

Signed and Sealed this

Twenty-ninth Day of June, 1999

*Attest:*

Q. TODD DICKINSON

*Attesting Officer*

*Acting Commissioner of Patents and Trademarks*